US008768199B2

(12) United States Patent
Sato et al.

(10) Patent No.: US 8,768,199 B2
(45) Date of Patent: Jul. 1, 2014

(54) IMAGE FORMING APPARATUS HAVING LIGHT GUIDING UNIT TO PROVIDE STAIN PREVENTION ON LATENT-IMAGE CARRIER

(75) Inventors: Naoki Sato, Kanagawa (JP); Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 200 days.

(21) Appl. No.: 13/192,258

(22) Filed: Jul. 27, 2011

(65) Prior Publication Data

US 2012/0224880 A1 Sep. 6, 2012

(30) Foreign Application Priority Data

Mar. 4, 2011 (JP) ..... 2011-048149

(51) Int. Cl.
*G03G 15/02* (2006.01)

(52) U.S. Cl.
USPC ..... 399/99

(58) Field of Classification Search
USPC ..... 399/99
See application file for complete search history.

(56) References Cited

FOREIGN PATENT DOCUMENTS

| | | | | |
|---|---|---|---|---|
| JP | 61198183 | A | * | 9/1986 |
| JP | 01191890 | A | * | 8/1989 |
| JP | 07175338 | A | * | 7/1995 |
| JP | 2002-244519 | A | | 8/2002 |
| JP | 2005037892 | A | * | 2/2005 |
| JP | 2010-8755 | A | | 1/2010 |
| JP | 2010-8973 | A | | 1/2010 |

OTHER PUBLICATIONS

Computer translation for JP07-175338A to Terai; Jul. 1995.*

* cited by examiner

*Primary Examiner* — Quana M Grainger
(74) *Attorney, Agent, or Firm* — Sughrue Mion, PLLC

(57) ABSTRACT

An image forming apparatus includes a latent-image carrier that is rotatable and carries a latent image on an outer peripheral surface thereof; a transfer unit that transfers a developer image obtained by developing the latent image with developer onto a transfer medium; a cleaning unit that is disposed downstream of the transfer unit in a rotational direction of the latent-image carrier and removes the developer from the latent-image carrier after the developer image is transferred; a light source that is disposed between the transfer unit and the cleaning unit and emits light for removing electric charge from the latent-image carrier; and a guiding member that is disposed below the cleaning unit and above a transport path of the transfer medium, receives the developer that falls from the cleaning unit at an upper surface thereof, and guides the light to the latent-image carrier.

5 Claims, 7 Drawing Sheets

IMAGE FORMING APPARATUS HAVING LIGHT GUIDING UNIT TO PROVIDE STAIN PREVENTION ON LATENT-IMAGE CARRIER

CROSS-REFERENCE TO RELATED APPLICATIONS

This application is based on and claims priority under 35 USC 119 from Japanese Patent Application No. 2011-048149 filed Mar. 4, 2011.

BACKGROUND

The present invention relates to an image forming apparatus.

SUMMARY

According to an aspect of the invention, there is provided an image forming apparatus including a latent-image carrier that is rotatable and carries a latent image on an outer peripheral surface of the latent-image carrier; a transfer unit that transfers a developer image obtained by developing the latent image with developer onto a transfer medium; a cleaning unit disposed downstream of the transfer unit in a rotational direction of the latent-image carrier, the cleaning unit removing the developer that remains on the outer peripheral surface of the latent-image carrier after the developer image is transferred; a light source disposed between the transfer unit and the cleaning unit, the light source emitting light for removing electric charge from the latent-image carrier; and a guiding member disposed below the cleaning unit and above a transport path of the transfer medium onto which the developer image is transferred, the guiding member being arranged to receive the developer that falls from the cleaning unit at an upper surface of the guiding member and guiding the light from the light source to the outer peripheral surface of the latent-image carrier.

BRIEF DESCRIPTION OF THE DRAWINGS

Exemplary embodiments of the present invention will be described in detail based on the following figures, wherein.

DETAILED DESCRIPTION

An image forming apparatus according to a first exemplary embodiment of the present invention will now be described.

Figure 1:
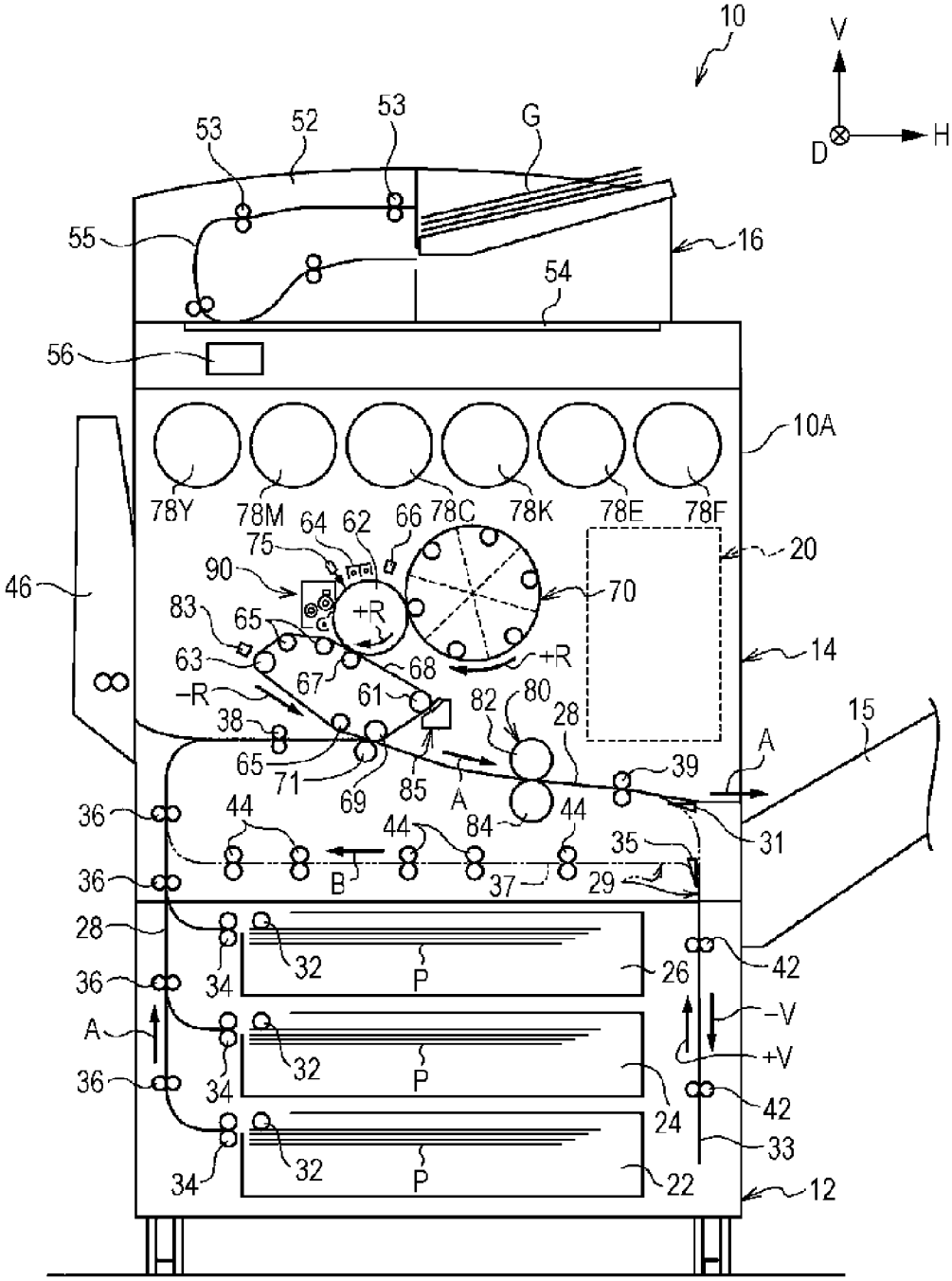
FIG. 1 illustrates the overall structure of an image forming apparatus according to a first exemplary embodiment of the present invention.

FIG. 1 illustrates an image forming apparatus 10 according to the first exemplary embodiment. The image forming apparatus 10 includes, in order from bottom to top in the vertical direction (direction of arrow V), a sheet storing unit 12 in which recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction, the left-right (horizontal) direction, and the depth (horizontal) direction with respect to an apparatus body 10A of the image forming apparatus 10 will be referred to as the direction of arrow V, the direction of arrow H, and the direction of arrow D, respectively.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 linearly extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow −V (downward in FIG. 1) from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H (leftward in FIG. 1). The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The manual sheet-feeding unit 46 is connected to the transport path 28 at a position in front of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transport rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical photoconductor 62, which is an example of a latent-image carrier, arranged in a central area of the apparatus body 10A. The photoconductor 62 is rotated in the direction shown by arrow +R (clockwise in FIG. 1) by a driving unit (not shown), and carries an electrostatic latent image formed by irradiation with light. In addition, a charging device 64 that charges the outer peripheral surface of the photoconductor 62 is provided above the photoconductor 62 so as to face the outer peripheral surface of the photoconductor 62.

Figure 2:
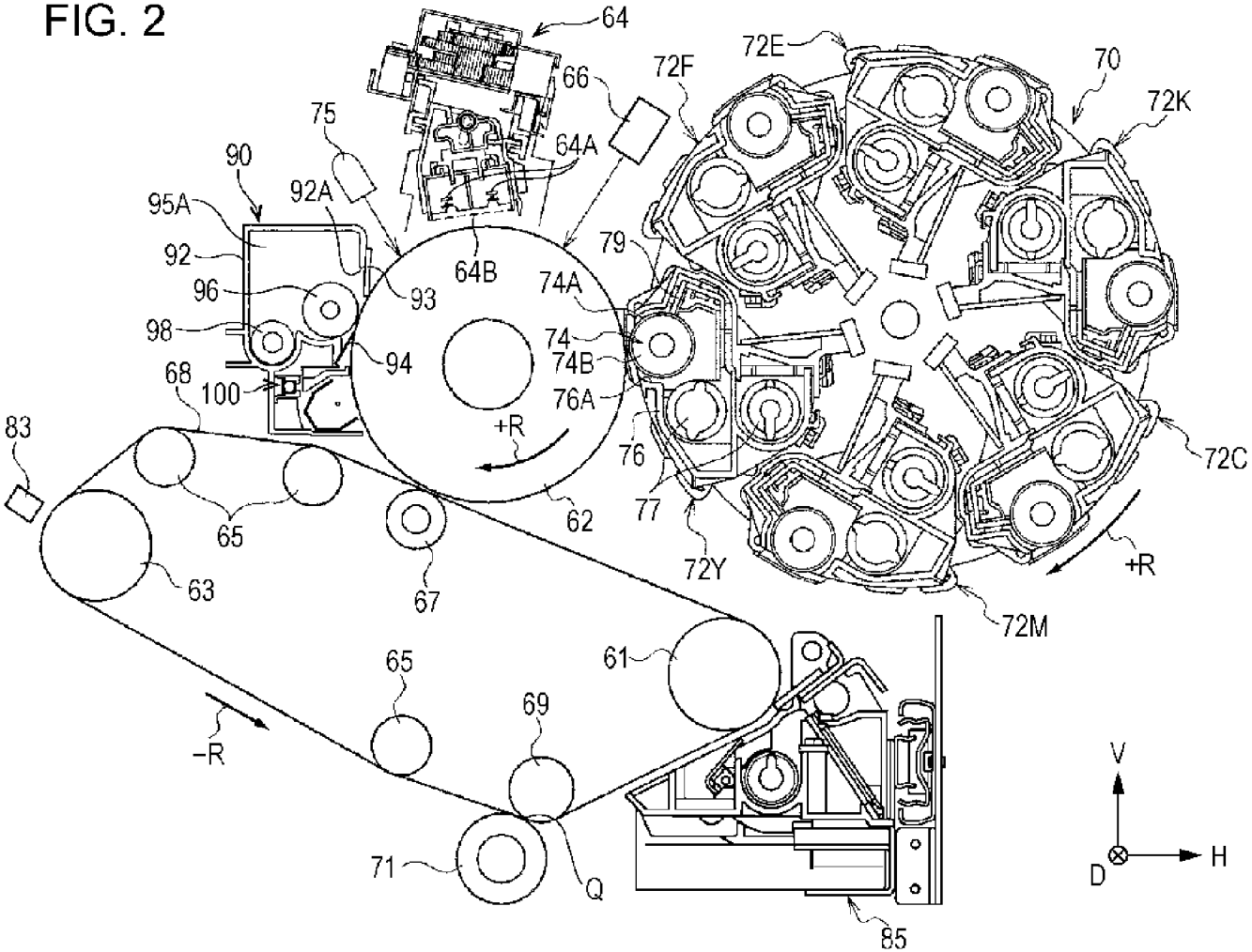
FIG. 2 illustrates the structure of an area around an image forming unit according to the first exemplary embodiment of the present invention.

As illustrated in FIG. 2, the charging device 64 includes two charge wires 64A and a grid electrode 64B. The charge wires 64A are spaced from each other in the rotational direction of the photoconductor 62 (direction shown by arrow +R) and extend in the axial direction of the photoconductor 62 (direction shown by arrow D). The grid electrode 64B is disposed between the outer peripheral surface of the photoconductor 62 and the charge wires 64A. In the charging device 64, a voltage is applied to the charge wires 64A, so that corona discharge occurs due to a voltage difference between the charge wires 64A and the photoconductor 62 that is grounded. As a result, the outer peripheral surface of the photoconductor 62 is charged with a set polarity (for example, negative polarity). A discharge current is controlled by applying a bias voltage to the grid electrode 64B, so that the charged state of the photoconductor 62 is maintained.

An exposure device 66 is provided so as to face the outer peripheral surface of the photoconductor 62 at a position downstream of the charging device 64 in the rotational direction of the photoconductor 62. The exposure device 66 includes a light emitting diode (LED). The outer peripheral surface of the photoconductor 62 that has been charged by the charging device 64 is irradiated with light (exposed to light) by the exposure device 66 on the basis of an image signal corresponding to each color of toner. Thus, an electrostatic latent image is formed. The exposure device 66 is not limited to those including LEDs. For example, the exposure device 66 may be structured such that the outer peripheral surface of the photoconductor 62 is scanned with a laser beam by using a polygon mirror.

A rotation-switching developing device 70 is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color. An intermediate transfer belt 68, which is an example of a transfer medium, is provided downstream of the developing device 70 in the rotational direction of the photoconductor 62 and below the photoconductor 62. A toner image formed on the outer peripheral surface of the photoconductor 62 is transferred onto the intermediate transfer belt 68.

The intermediate transfer belt 68 is an endless belt, and is wound around a driving roller 61 that is rotated by the controller 20 (see FIG. 1), a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow −R (counterclockwise in FIG. 2) when the driving roller 61 is rotated. The path along which the intermediate transfer belt 68 is rotated is an example of a transport path of the transfer medium.

A first transfer roller 67, which is an example of a transfer unit, is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71 is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position (position Q in FIG. 2) at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P (see FIG. 1).

A cleaning unit 85 is opposed to the driving roller 61 with the intermediate transfer belt 68 interposed therebetween. The cleaning unit 85 collects residual toner that remains on the intermediate transfer belt 68 after the second transfer process. A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 90, which is an example of a cleaning unit, is provided downstream of the first transfer roller 67 in the rotational direction of the photoconductor 62. The cleaning device 90 removes residual toner and the like that remain on the outer peripheral surface of the photoconductor 62 instead of being transferred onto the intermediate transfer belt 68 in the first transfer process.

The cleaning device 90 includes a housing 92 that extends in the direction shown by arrow D. The housing 92 has an opening 92A in a side wall thereof that faces the photoconductor 62. A top end portion of a cleaning blade 93 is attached to the housing 92 at the top end of the opening 92A, and a bottom end portion of a sealing member 94 is attached to the housing 92 at the bottom end of the opening 92A. A brush roller 96 that is in contact with the outer peripheral surface of the photoconductor 62 at the opening 92A is disposed in the housing 92 in a rotatable manner. A transporting member 98 that transports the toner collected in the housing 92 in the direction shown by arrow D is disposed in a rotatable manner at a side of the brush roller 96 opposite to the photoconductor 62. A chamber in which the brush roller 96 and the transporting member 98 are disposed in the housing 92 is defined as a cleaning chamber 95A.

The cleaning blade 93 is in contact with the outer peripheral surface of the photoconductor 62 such that a bottom end portion (distal end portion) thereof points upstream in the rotational direction of the photoconductor 62 (direction shown by arrow +R). The distal end portion of the cleaning blade 93 scrapes off the toner and the like that adheres to the outer peripheral surface of the photoconductor 62. The toner that remains on the outer peripheral surface of the photoconductor 62 is collected by the cleaning blade 93 and the brush roller 96.

The sealing member 94 is a rectangular flexible sheet member that is attached to the housing 92 so as to extend in the direction shown by arrow D. A distal end portion of the sealing member 94 points toward the contacting portions of the photoconductor 62 and the brush roller 96, so that the toner removed by the brush roller 96 does not flow out of the housing 92. The distal end portion of the sealing member 94 is in contact with the outer peripheral surface of the photoconductor 62 without applying a load thereto.

The sealing member 94 does not apply an external force that is large enough to scrape off the toner that adheres to the outer peripheral surface of the photoconductor 62. Therefore, the toner that adheres to the outer peripheral surface of the photoconductor 62 passes the sealing member 94 and is transported to the brush roller 96 and the cleaning blade 93. However, since the distal end portion of the sealing member 94 is in contact with the outer peripheral surface of the photoconductor 62, the toner sometimes falls from the contact position between the sealing member 94 and the photoconductor 62.

An erase lamp 75 for removing the electric charge from the outer peripheral surface of the photoconductor 62 after the collection of the residual toner by the cleaning device 90 may be provided downstream of the cleaning device 90 and upstream of the charging device 64.

As illustrated in FIG. 1, the second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71.

The fixing device 80 includes a heating roller 82 and a pressing roller 84. The heating roller 82 is disposed at the side of the sheet of recording paper P at which the toner images are formed (upper side) and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the direction shown by arrow H in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected.

When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

Next, electricity is applied to the charge wires 64A (see FIG. 2) in the charging device 64, so that a potential difference is generated between the charge wires 64A and the photoconductor 62 that is grounded. Accordingly, corona discharge occurs and the outer peripheral surface of the photoconductor 62 is charged. At this time, a bias voltage is applied to the grid electrode 64B (see FIG. 2), so that the charged potential (discharge current) of the photoconductor 62 is within an allowable range.

The exposure device 66 emits light in accordance with the image data, and the outer peripheral surface of the photoconductor 62, which has been charged by the charging device 64, is exposed to the emitted light. Accordingly, an electrostatic latent image corresponding to the yellow image data is formed on the outer peripheral surface of the photoconductor 62. The electrostatic latent image formed on the outer peripheral surface of the photoconductor 62 is developed as a yellow toner image by the developing unit 72Y. The yellow toner image on the outer peripheral surface of the photoconductor 62 is transferred onto the intermediate transfer belt 68 by the first transfer roller 67.

Then, referring to FIG. 2, the developing device 70 is rotated by 60° in the direction shown by arrow +R, so that the developing unit 72M is opposed to the outer peripheral surface of the photoconductor 62. Then, the charging process, the exposure process, and the developing process are performed so that a magenta toner image is formed on the outer peripheral surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

A sheet of recording paper P is fed from the sheet storing unit 12 and transported along the transport path 28, as illustrated in FIG. 1. Then, the sheet is transported by the positioning rollers 38 to the second transfer position (position Q in FIG. 2) in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction shown by arrow A (rightward in FIG. 1). The fixing device 80 fixes the toner images to the sheet of recording paper P by applying heat and pressure thereto with the heating roller 82 and the pressing roller 84. The sheet of recording paper P to which the toner images are fixed is ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction shown by arrow −V. Then, the sheet of recording paper P is transported in the direction shown by arrow +V, so that the leading and trailing edges of the sheet of recording paper P are reversed. Then, the sheet of recording paper P is transported along the duplex-printing transport path 29 in the direction shown by arrow B (leftward in FIG. 1), and is inserted into the transport path 28. Then, the back surface of the sheet of recording paper P is subjected to the image forming process and the fixing process.

Next, the structure of an erase unit 100 and an area around the erase unit 100 will be described.

Figure 3:
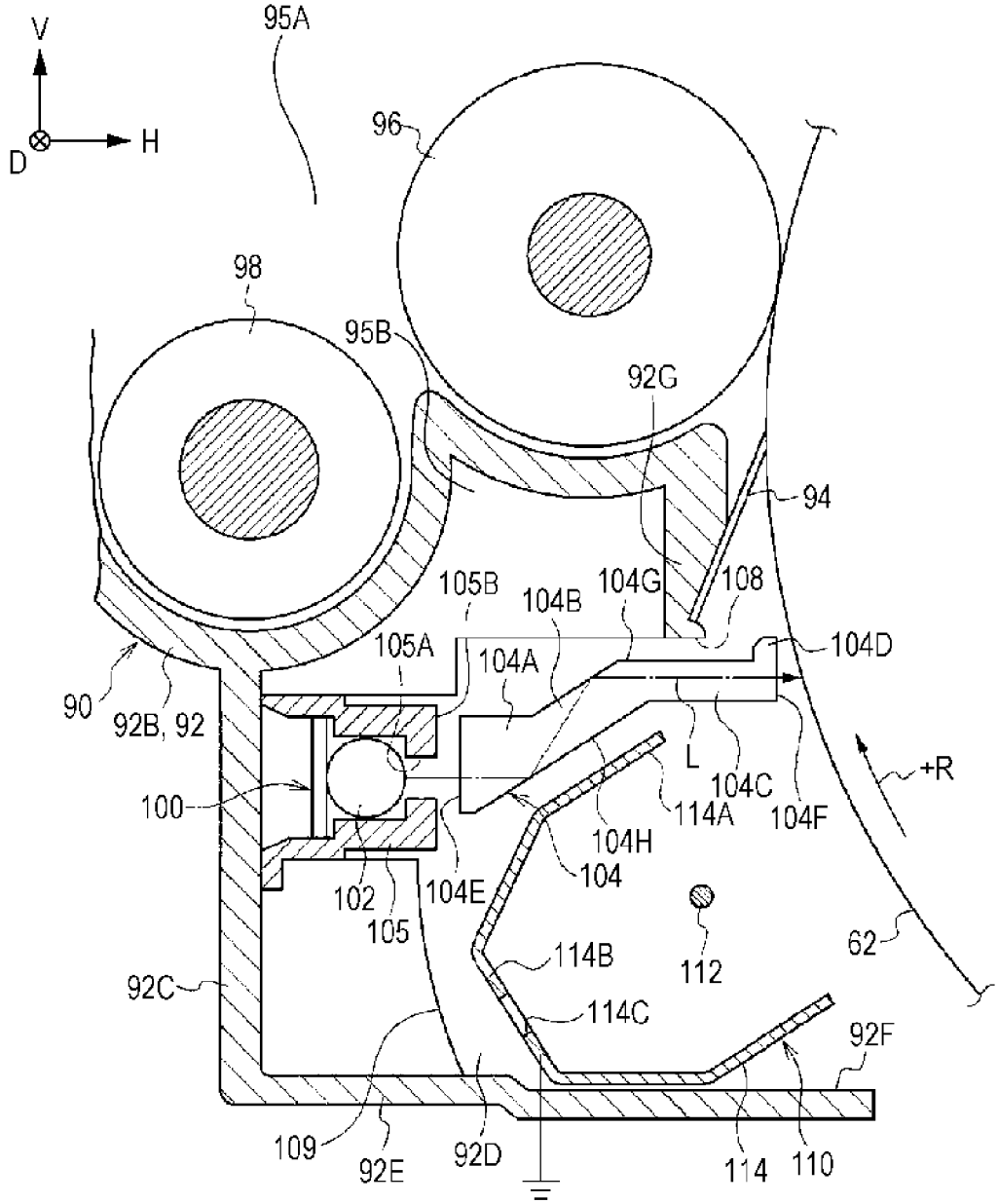
FIG. 3 illustrates the structure of an area around an erase unit according to the first exemplary embodiment of the present invention.

As illustrated in FIG. 3, the housing 92 of the cleaning device 90 includes a curved wall 92B above which the brush roller 96 and the transporting member 98 are disposed. A side wall 92C which extends downward in the direction shown by arrow V along the D-V plane and a pair of side walls 92D that extend along the H-V plane are provided on the bottom surface of the curved wall 92B. A flat plate shaped bottom wall 92E that extends in the direction shown by arrow H is provided at the bottom ends of the side wall 92C and the side walls 92D.

The side wall 92C, the side walls 92D, and the bottom wall 92E are formed integrally with the curved wall 92B, and the housing 92 includes an erase chamber 95B surrounded by the curved wall 92B, the side wall 92C, the side walls 92D, and the bottom wall 92E. In addition, the housing 92 has an opening 92F defined by the edges of the curved wall 92B, the pair of side walls 92D, and the bottom wall 92E.

A post-transfer corotron 110, which is an example of a post-transfer charging unit, is provided in the erase chamber 95B at an upstream side in the rotational direction of the photoconductor 62 (direction shown by arrow +R). In addition, the erase unit 100 is disposed downstream of the post-transfer corotron 110 and upstream of the sealing member 94 in the rotational direction of the photoconductor 62 (direction shown by arrow +R). The erase unit 100 is provided not only to reduce the adhesive force caused by static electricity and applied to the toner that adheres to the photoconductor 62 before the residual toner is collected by the cleaning device 90. More specifically, in the image forming apparatus 10 (see FIG. 1), the erase unit 100 also serves to remove the electric charge from the photoconductor 62 in advance to avoid a situation in which the electric charge on the photoconductor 62 cannot be eliminated by the erase lamp 75 in the case where the diameter of the photoconductor 62 is small or the image forming speed is high.

The post-transfer corotron 110 includes a charge wire 112 to which a voltage is applied by a voltage applying unit (not shown) and a grounded shielding member 114 which covers the charge wire 112 and in which an opening 114A is formed at a side that faces the photoconductor 62. The shielding member 114 includes a side wall 114B provided at a side opposite to the opening 114A (at a side adjacent to a discharge hole 109), and a through hole 114C is formed in the side wall 114B. Accordingly, air is allowed to flow from the inside of the shielding member 114 to the discharge hole 109.

The post-transfer corotron 110 has a function of changing the reverse polarity (positive polarity in the present exemplary embodiment) of the electric charge that remains on the outer peripheral surface of the photoconductor 62 to the polarity with which the photoconductor 62 is charged by the charging device 64 (see FIG. 2), that is, to the negative polarity, after the first transfer process is performed by the first transfer roller 67 (see FIG. 2). This is because if the photoconductor 62 is charged with the reverse polarity, the electric charge cannot be removed by the erase unit 100.

The erase unit 100 includes an erase lamp 102, which is an example of a light source, and a reflector 104, which is an example of a guiding member and which reflects light L from the erase lamp 102 (shown by the dotted chain line in FIG. 3) so as to guide the light L to the outer peripheral surface of the photoconductor 62.

The erase lamp 102 is disposed next to the side wall 92C. In other words, the erase lamp 102 is positioned between the first transfer roller 67 (see FIG. 2) and the cleaning device 90. The erase lamp 102 emits the light L when electricity is supplied thereto from a power source unit (not shown), and the electric charge on the photoconductor 62 is removed by the light L. The erase lamp 102 is covered by a cover member 105 having an opening 105A in a side wall in the direction in which the light L is emitted, that is, in the direction shown by arrow H. The opening 105A serves as an exit opening from which the light L is emitted.

The reflector 104 is a light-guiding member including a light entrance portion 104A, an inclined portion 104B, an exit portion 104C, and a projecting portion 104D, which are formed integrally with each other. The light entrance portion 104A faces the opening 105A in the direction shown by arrow H so that the light L enters the entrance portion 104A. The inclined portion 104B extends from the light incident portion 104A obliquely upward (toward the upper right in FIG. 3) with respect to the direction shown by arrow H. The exit portion 104C extends parallel to the direction shown by arrow H from the top end of the inclined portion 104B, and the light L is emitted toward the photoconductor 62 from the exit portion 104C. The projecting portion 104D projects upward in the direction shown by arrow V by a predetermined amount from an end portion of the exit portion 104C that is near the photoconductor 62. The reflector 104 is disposed below the cleaning device 90 and above the intermediate transfer belt (see FIG. 2). The projecting portion 104D is located below the position at which the distal end portion of the sealing member 94 is in contact with the outer peripheral surface of the photoconductor 62.

The entrance portion 104A includes an entrance surface 104E which is a vertical surface that faces a side surface 105B of the cover member 105 in which the opening 105A is formed and on which the light L is incident. The exit portion 104C includes an exit surface 104F which faces the outer peripheral surface of the photoconductor 62 and from which the light L is emitted. The reflector 104 has an upper surface 104G and a lower surface 104H, and the upper surface 104G and the lower surface 104H in the reflector 104 function as reflective surfaces that reflect the light L. Accordingly, in the reflector 104, the light L, for example, is incident on the entrance surface 104E, is reflected by the lower surface 104H and the upper surface 104G, and is emitted toward the outer peripheral surface of the photoconductor 62 through the exit surface 104F.

An attachment portion 92G, which is a vertical wall to which the above-described sealing member 94 is attached, is formed integrally with the curved wall 92B at an end thereof that is near the photoconductor 62. Suction holes 108 are formed between the bottom surface of the attachment portion 92G and the upper surface 104G of the reflector 104.

Figure 4A:
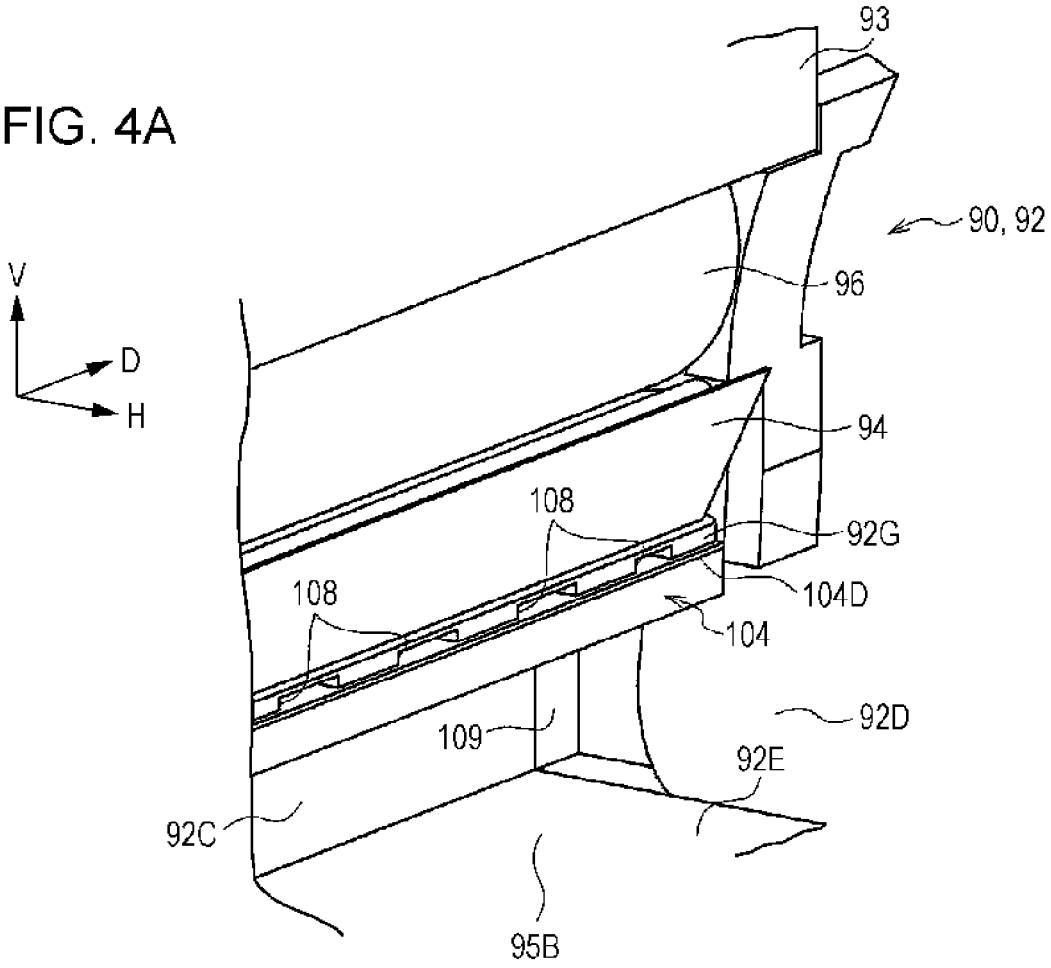
FIG. 4A is a perspective view illustrating a discharge hole disposed below the erase unit according to the first exemplary embodiment of the present invention.

As illustrated in FIG. 4A, the suction holes 108 have, for example, a rectangular shape that extends in the direction shown by arrow D and are arranged with intervals therebetween in the direction shown by arrow D. In addition, the discharge hole 109 is formed in a lower portion of one of the side walls 92D of the erase chamber 95B so as to extend therethrough in the direction shown by arrow D at a position near the side wall 92C.

Figure 4B:
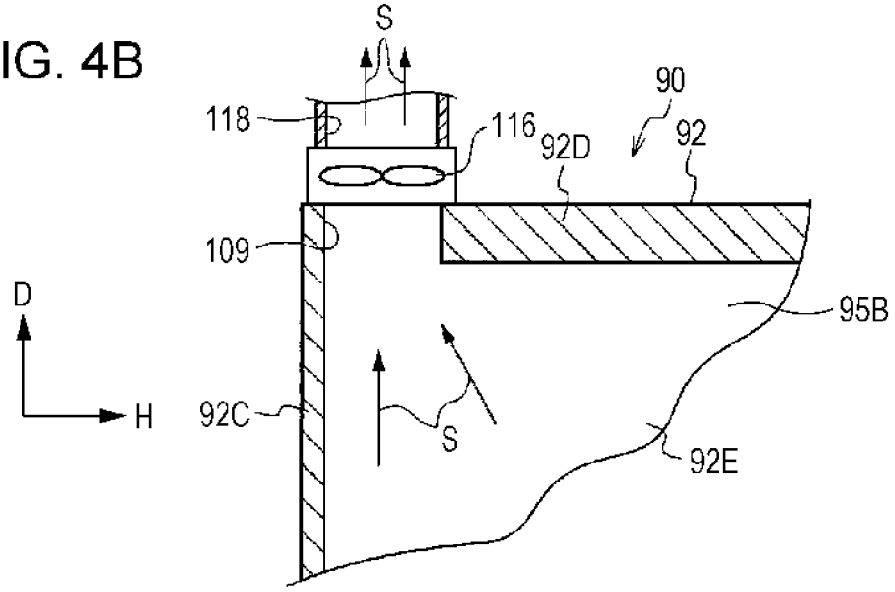
FIG. 4B illustrates the state in which a suction operation is performed by a suction unit according to the first exemplary embodiment of the present invention.

As illustrated in FIG. 4B, a suction fan 116, which is an example of a suction unit, is attached to the housing 92 at a position outside the discharge hole 109. An exhaust duct 118 is provided on the suction fan 116 at a side opposite to the discharge hole 109. The suction fan 116 is operated or the operation thereof is stopped under the control of the controller 20 (see FIG. 1). When the suction fan 116 is operated, the air in the erase chamber 95B and the shielding member 114 (see FIG. 3) is sucked in the directions shown by arrows S and is exhausted to the outside of the housing 92. The exhaust duct 118 extends to a discharge hole (not shown) formed in a back cover of the image forming apparatus 10 (see FIG. 1). A dust collection filter (not shown) for removing the toner and the like and an ozone filter (not shown) for removing ozone generated in the discharge process are provided at the discharge hole.

Next, the operation of the first exemplary embodiment will be described.

Figure 5:
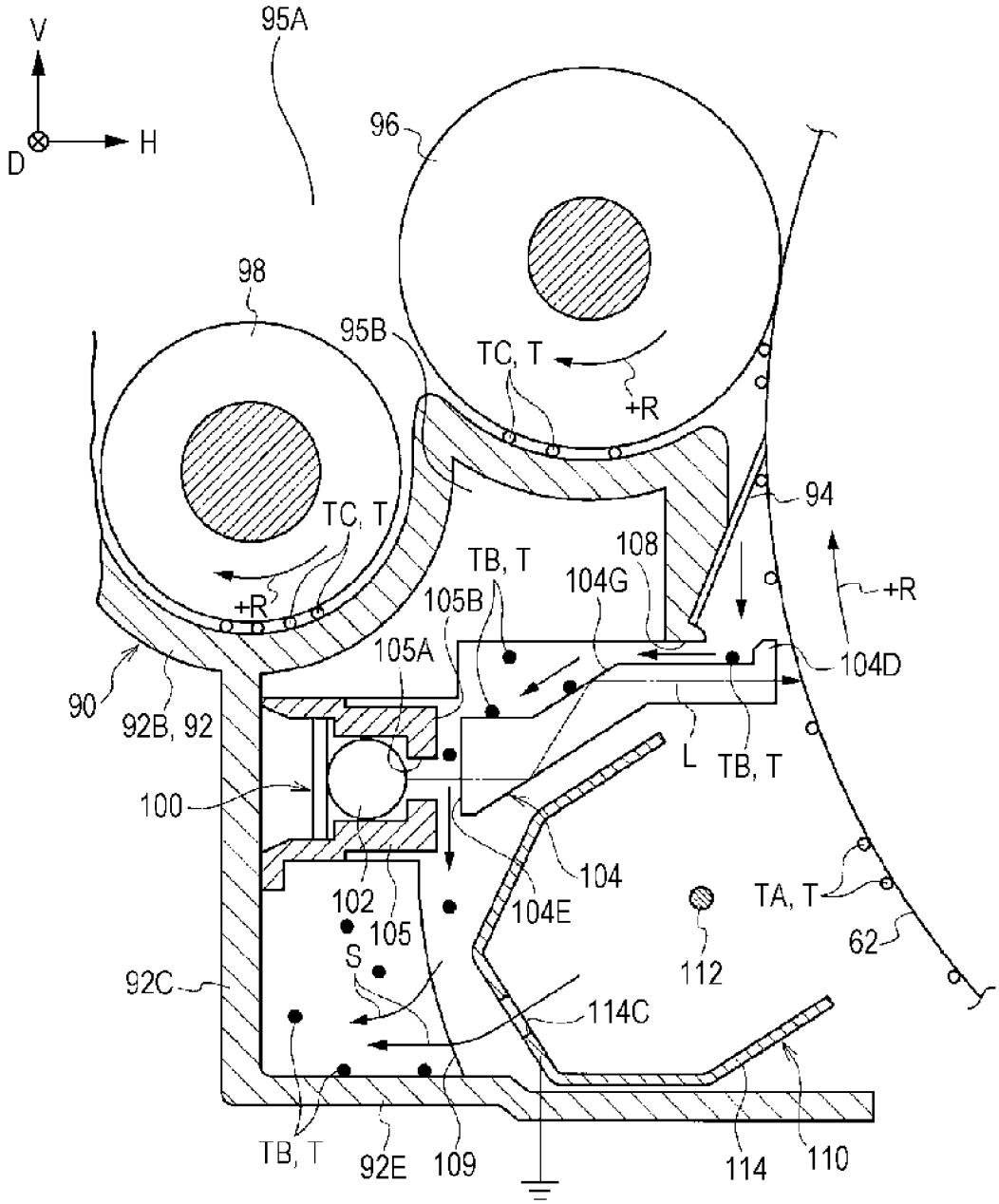
FIG. 5 illustrates the manner in which toner is collected in the area around the erase unit in the first exemplary embodiment of the present invention.

Referring to FIG. 5, when the image forming unit 14 (see FIG. 1) starts to perform the image forming process, the photoconductor 62 rotates in the direction shown by arrow +R. In addition, the suction fan 116 (see FIG. 4B) is driven so that the air is exhausted through the discharge hole 109. Then, the polarity of the electric charge on the outer peripheral surface of the photoconductor 62 is set to the negative polarity by the post-transfer corotron 110. Then, the light L emitted from the erase lamp 102 is guided by the reflector 104 toward the outer peripheral surface of the photoconductor 62. Accordingly, the negative-polarity charge on the photoconductor 62 is reduced to a level suitable for the cleaning process performed by the cleaning blade 93.

Discharge products (for example, ozone), are generated at the post-transfer corotron 110 as a result of corona discharge. However, since the air is allowed to flow from the inside of the shielding member 114 to the outside thereof through the through hole 114C, that is, since the air is sucked (discharged) through the through hole 114C, the discharge products flow through the through hole 114C and the discharge hole 109 and are collected by the filter (not shown).

The toner T (shown by white circles in FIG. 5) that has not been transferred onto the intermediate transfer belt 68 (see FIG. 2) in the first transfer process adheres to (remains on) the outer peripheral surface of the photoconductor 62 and is transported to the cleaning device 90. Then, the toner T is removed from the outer peripheral surface of the photoconductor 62 by the cleaning blade 93 (see FIG. 2) and the brush roller 96 and is collected into the housing 92, where the toner T is transported by the transporting member 98. In FIG. 5, some of the toner T that adheres to the outer peripheral surface of the photoconductor 62 is referred to as toner TA, some of the toner T that falls from the contact position between the sealing member 94 and the photoconductor 62 is referred to as toner TB, and some of the toner T that is collected by the cleaning device 90 is referred to as toner TC. The toner TA and the toner TC are shown by white circles, and the toner TB is shown by black circles.

The toner TB, which receives a weak adhesive force, is scraped off by the distal end portion of the sealing member 94 at the contact position between the outer peripheral surface of the photoconductor 62 and the sealing member 94. Since the projecting portion 104D at the end of the reflector 104 is disposed below the contact position between the sealing member 94 and the photoconductor 62, the toner TB that has fallen is received by the upper surface 104G of the reflector 104. Accordingly, the toner TB is prevented from falling onto the intermediate transfer belt 68 (see FIG. 2). Therefore, the image on the intermediate transfer belt 68 is prevented from being stained.

In addition, since the air is sucked (discharged) by the suction fan 116 (see FIG. 4B) in the directions shown by arrows S, the toner TB that has fallen onto the upper surface 104G of the reflector 104 is sucked into the erase chamber 95B through the suction holes 108. Then, the toner TB moves along the upper surface 104G in the directions shown by the arrows, passes through the gap between the side surface 105B and the entrance surface 104E, and falls onto the bottom wall 92E. Then, the toner TB is discharged to the outside of the erase chamber 95B through the discharge hole 109, and is collected by the filter (not shown).

Thus, the air is continuously sucked through the suction holes 108, and the toner TB that has fallen onto the upper surface 104G of the reflector 104 is forcibly collected. Thus, the toner TB is prevented from adhering to the outer peripheral surface of the photoconductor 62 again. The amount of the toner TB that falls is not so large as to block the light L emitted from the erase lamp 102. Therefore, the operation of removing the electric charge from the photoconductor 62 is not affected by the toner TB.

Next, an image forming apparatus according to a second exemplary embodiment of the present invention will be described. Components that are basically identical to those of the first exemplary embodiment are denoted by the same reference numerals as those in the first exemplary embodiment, and explanations thereof are thus omitted.

Figure 6:
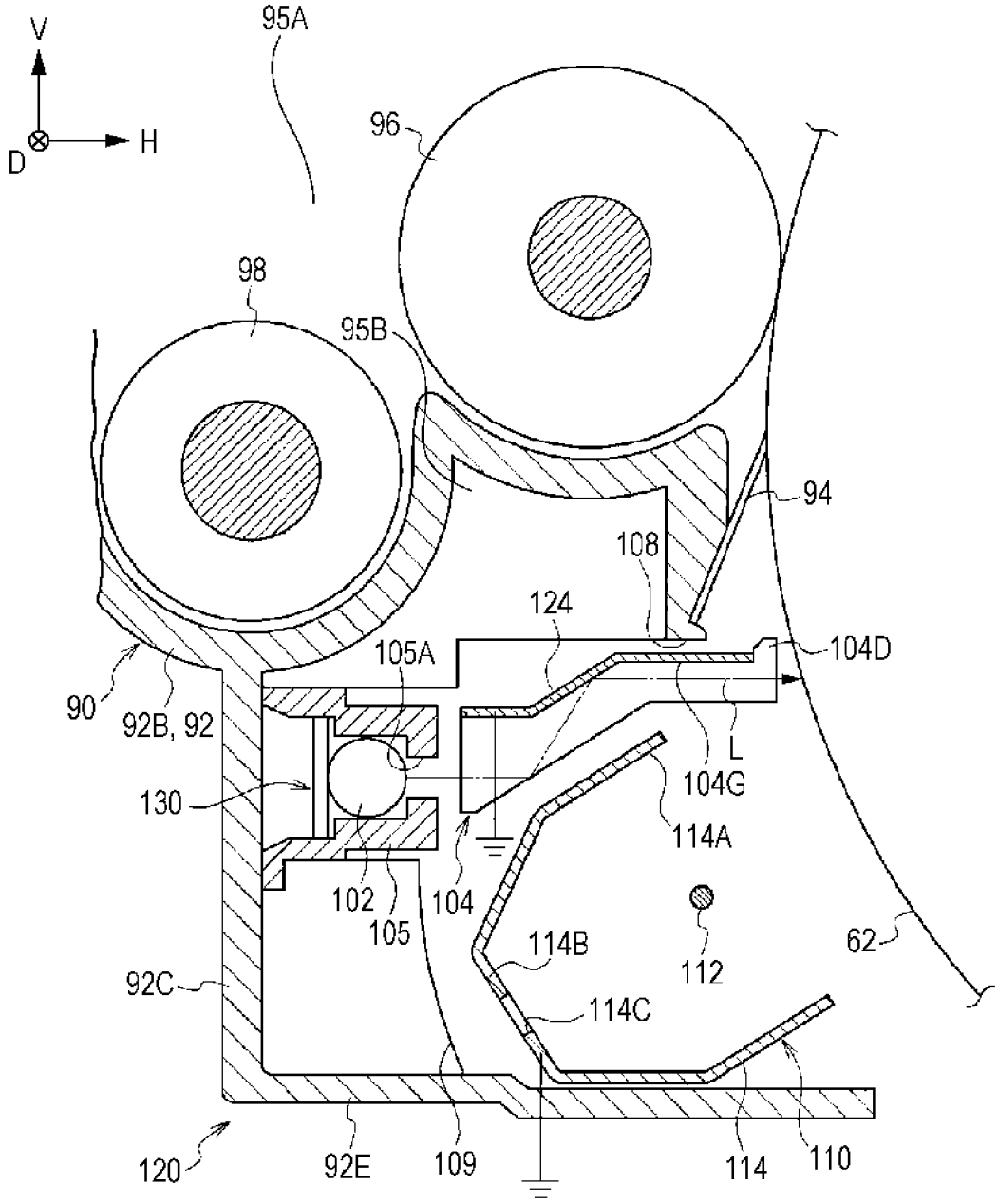
FIG. 6 illustrates the structure of an area around an erase unit according to a second exemplary embodiment of the present invention.

FIG. 6 illustrates an area around a cleaning device 90 included in an image forming apparatus 120 according to the second exemplary embodiment. The image forming apparatus 120 includes a post-transfer corotron 110 similar to that in the above-described image forming apparatus 10 (see FIG. 1), but includes an erase unit 130 in place of the erase unit 100.

The erase unit 130 includes an erase lamp 102 and a reflector 104. A conductive sheet 124, which is grounded, is bonded to an upper surface 104G of the reflector 104.

Next, the operation of the second exemplary embodiment will be described.

Figure 7:
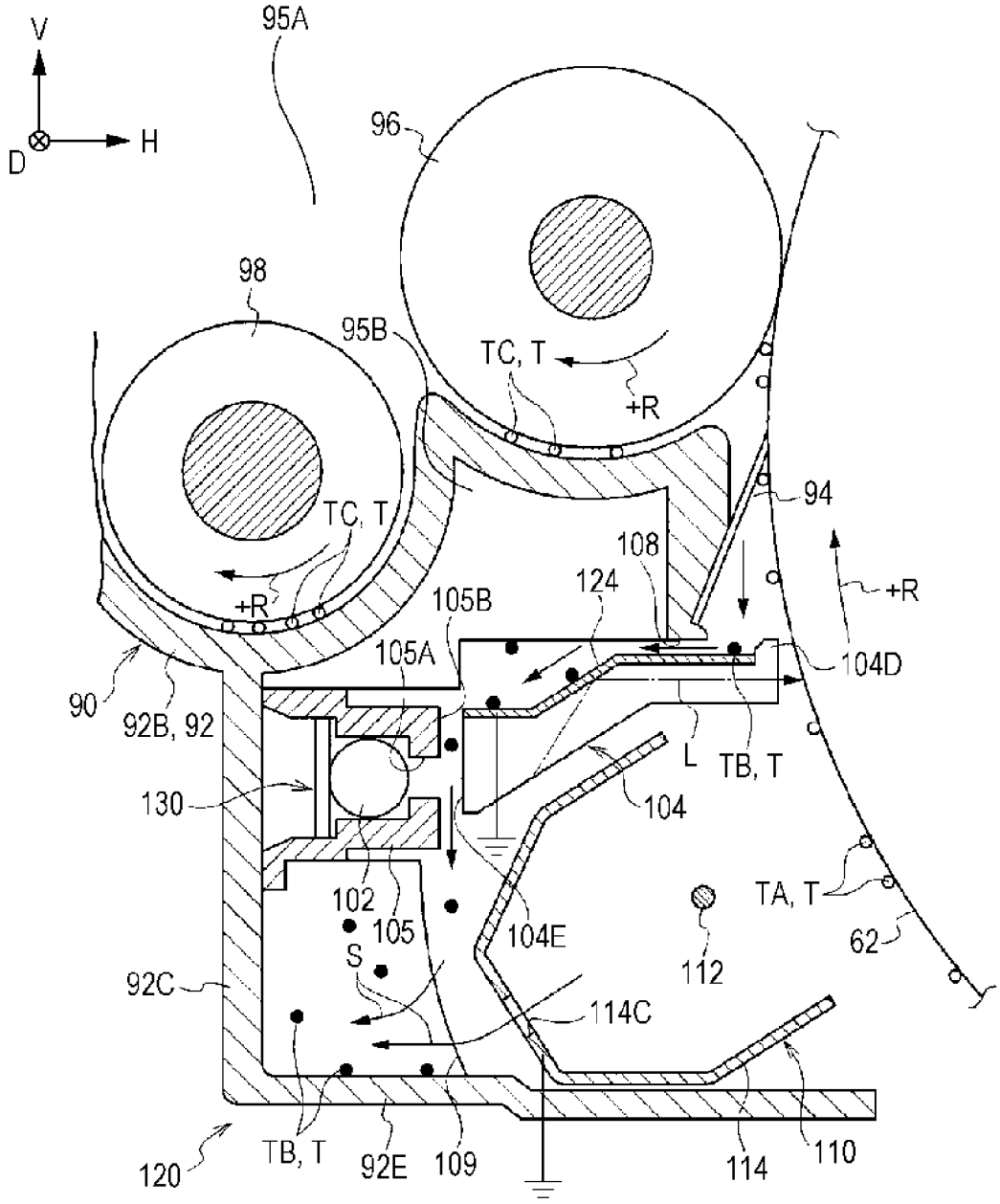
FIG. 7 illustrates the manner in which toner is collected in the area around the erase unit in the second exemplary embodiment of the present invention.

Referring to FIG. 7, when the image forming unit 14 (see FIG. 1) starts to perform the image forming process, the photoconductor 62 rotates in the direction shown by arrow +R. In addition, the suction fan 116 (see FIG. 4B) is driven so that the air is exhausted through the discharge hole 109. Then, the polarity of the electric charge on the outer peripheral surface of the photoconductor 62 is set to the negative polarity by the post-transfer corotron 110. Then, the light L emitted from the erase lamp 102 is guided by the reflector 104 toward the outer peripheral surface of the photoconductor 62. Accordingly, the negative-polarity charge on the photoconductor 62 is reduced to a level suitable for the cleaning process performed by the cleaning blade 93.

Discharge products (for example, ozone), are generated at the post-transfer corotron 110 as a result of corona discharge. However, since the air is allowed to flow from the inside of the shielding member 114 to the outside thereof through the through hole 114C, that is, since the air is sucked through the through hole 114C, the discharge products flow through the through hole 114C and the discharge hole 109 and are collected by the filter (not shown).

The toner TA that has not been transferred onto the intermediate transfer belt 68 (see FIG. 2) in the first transfer process adheres to (remains on) the outer peripheral surface of the photoconductor 62 and is transported to the cleaning device 90. Then, the toner TA is removed from the outer peripheral surface of the photoconductor 62 by the cleaning blade 93 (see FIG. 2) and the brush roller 96 and is collected into the housing 92 (toner TC), where the toner T is transported by the transporting member 98.

The toner TB, which receives a weak adhesive force, is scraped off by the distal end portion of the sealing member 94 at the contact position between the outer peripheral surface of the photoconductor 62 and the sealing member 94. Since the projecting portion 104D at the end of the reflector 104 is disposed below the contact position between the sealing member 94 and the photoconductor 62, the toner TB that has fallen is received by the conductive sheet 124 on the upper surface 104G of the reflector 104. Accordingly, the toner TB is prevented from falling onto the intermediate transfer belt 68 (see FIG. 2). Therefore, the image on the intermediate transfer belt 68 is prevented from being stained.

In addition, since the air is sucked (discharged) by the suction fan 116 (see FIG. 4B) in the directions shown by arrows S, the toner TB that has fallen onto the conductive sheet 124 is forcibly sucked into the erase chamber 95B through the suction holes 108. Then, the toner TB moves along the conductive sheet 124 in the directions shown by the arrows, passes through the gap between the side surface 105B and the entrance surface 104E, and falls onto the bottom wall 92E. Then, the toner TB is discharged to the outside of the erase chamber 95B through the discharge hole 109, and is collected by the filter (not shown). Thus, the air is continuously sucked through the suction holes 108, and the toner TB that has fallen onto the conductive sheet 124 is forcibly collected. Thus, the toner TB is prevented from adhering to the outer peripheral surface of the photoconductor 62 again.

In addition, since the conductive sheet 124 is grounded, the adhesive force based on the electrostatic attractive force applied to the toner TB by the conductive sheet 124 is reduced irrespective of the polarity of the toner TB that has fallen onto the conductive sheet 124. Accordingly, the toner TB is prevented from being fixed to the conductive sheet 124 or the reflector 104. Thus, also in the image forming apparatus 120 according to the second exemplary embodiment, the toner TB may be collected and the discharge products may be discharged at the same time.

The present invention is not limited to the above-described exemplary embodiments.

Instead of using the suction fan 116, the toner T that has fallen onto the reflector 104 may be caused to accumulate. Then, the toner T may be collected by replacing the reflector 104. In such a case, the upper surface of the reflector 104 may be coated with an adhesive material, so that the toner T may be prevented from adhering to the photoconductor 62 again. In addition, the discharge hole 109 may be formed in the side wall 92C. In addition, the post-transfer corotron 110 may be omitted. In such a case, a dedicated suction unit for sucking the toner T may be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent-image carrier that is rotatable and carries a latent image on an outer peripheral surface of the latent-image carrier;

a transfer unit that transfers a developer image obtained by developing the latent image with developer onto a transfer medium;

a cleaning unit disposed downstream of the transfer unit in a rotational direction of the latent-image carrier, the cleaning unit removing the developer that remains on the outer peripheral surface of the latent-image carrier after the developer image is transferred;

a light source disposed between the transfer unit and the cleaning unit, the light source emitting light for removing electric charge from the latent-image carrier;

a guiding member disposed below the cleaning unit and above a transport path of the transfer medium onto which the developer image is transferred, the guiding member being arranged to receive the developer that falls from the cleaning unit directly on an upper surface of the guiding member and guiding the light from the light source to the outer peripheral surface of the latent-image carrier; and a suction unit that sucks the developer from the upper surface of the guiding member.

2. The image forming apparatus according to claim 1, further comprising:

a post-transfer charging unit disposed between the transfer unit and the guiding member so as to face the outer peripheral surface of the latent-image carrier, the post-transfer charging unit charging the outer peripheral surface of the latent-image carrier after the developer image is transferred, wherein the suction unit not only sucks the developer on the guiding member but also sucks air from the post-transfer charging unit.

3. The image forming apparatus according to claim 1, wherein a grounded conductive member is attached to the upper surface of the guiding member.

4. The image forming apparatus according to claim 2, wherein a grounded conductive member is attached to the upper surface of the guiding member.

5. The image forming apparatus according to claim 1, wherein the upper surface of the guiding unit and a housing of the cleaning device are offset in a gravitational direction.

* * * * *